US005245246A

United States Patent [19]

Boland et al.

[11] Patent Number: 5,245,246

[45] Date of Patent: Sep. 14, 1993

[54] GAS DISCHARGE LAMP TEMPERATURE CONTROL

[75] Inventors: Steven H. Boland, Glendora; John S. Goldner, San Jose, both of Calif.

[73] Assignee: BHK, Inc., Pomona, Calif.

[21] Appl. No.: 805,993

[22] Filed: Dec. 9, 1991

[51] Int. Cl.[5] ..... H01J 61/30; H01J 61/52

[52] U.S. Cl. ..... 313/15; 313/13; 313/25; 313/44; 313/46; 313/610; 313/634

[58] Field of Search ..... 313/13, 15, 17, 25, 313/33, 44, 46, 564, 610, 625, 634, 325, 358

[56] References Cited

U.S. PATENT DOCUMENTS

| | | | |
|---|---|---|---|
| 3,790,852 | 2/1974 | Bolin et al. | 313/15 X |
| 4,024,431 | 5/1977 | Young | 313/15 X |
| 4,877,997 | 10/1989 | Fein | 313/22 X |
| 4,965,484 | 10/1990 | Fein | 313/15 |
| 5,055,979 | 10/1991 | Boland et al. | 313/634 X |

*Primary Examiner*—Donald J. Yusko
*Assistant Examiner*—Ashok Patel
*Attorney, Agent, or Firm*—Boniard I. Brown

[57] ABSTRACT

A low pressure gas discharge lamp of the capillary bore type is equipped with a temperature control system whereby the electrode containment section and the light output section of the lamp are at higher temperatures than the capillary bore section. Vapor flow from the higher temperature sections to the relatively low capillary bore section maintains a satisfactory vapor fill in the bore section for attainment of a high light output. In one arrangement, the temperature control system includes a heater and a heat sink at selected points along the lamp envelope. In another form of the invention, the control system is solely a heat sink in thermal contact with the capillary bore section.

9 Claims, 1 Drawing Sheet

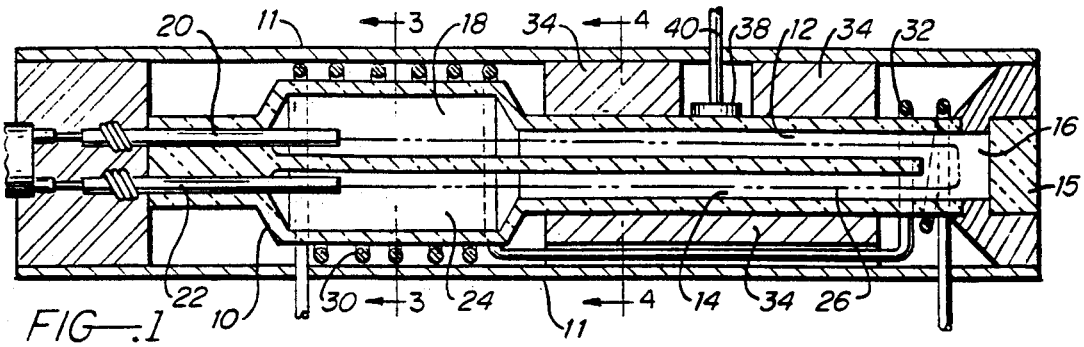
FIG—.1
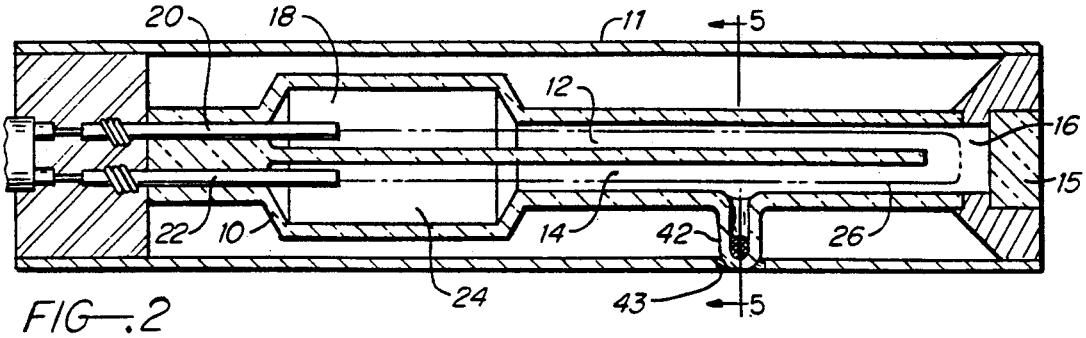
FIG—.2
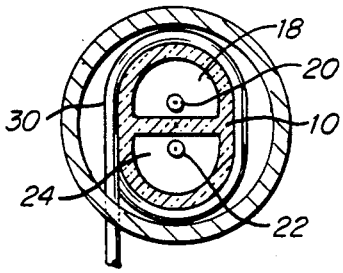
FIG—.3
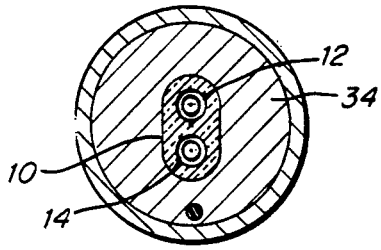
FIG—.4
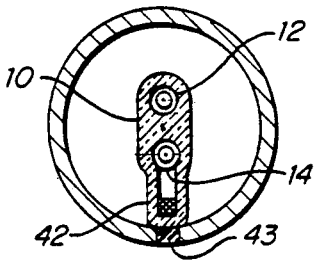
FIG—.5
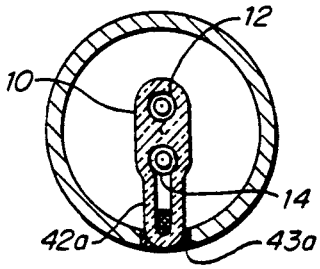
FIG—.6

GAS DISCHARGE LAMP TEMPERATURE CONTROL

BACKGROUND AND SUMMARY OF THE INVENTION

The present invention relates to a capillary bore gas discharge lamp of the general type disclosed in my U. S. Pat. No. 5,055,979 entitled "Gas Discharge Light Source", and in U. S. Pat. No. 4,877,997 to Fein entitled "High Brightness End Viewed Gas Discharge Lamp". As stated in the latter patent, capillary bore gas discharge lamps using mercury have the brightest (highest) light output when the lamp is operated in a temperature range of 10°-70° C. An optimum temperature for mercury vapor lamps appears to be about 40° C. (105° F.), which corresponds to an ideal vapor density.

When a mercury vapor lamp has very different cross-sectional dimensions, the temperature can be different at the different cross-sections. In order to maintain the mercury vapor at a near ideal density in critical bore areas of the lamp envelope, the present invention proposes the use of electrical heater means and/or heat sink means at preselected locations along the lamp envelope.

Photon (light) output is related, at least in part, to the number of vapor molecules under bombardment by the flowing electrons. In the case of low pressure mercury vapor lamps, an optimum number of vapor molecules is apparently obtained when the vapor in the capillary bores is at a temperature of about 40°-70° C. The present invention contemplates heating means and dissipating means for maintaining the vapor in the lamp capillary bore section at or near an optimum operating temperature, i.e., 40° C. in the case of a low pressure mercury vapor lamp.

Temperature non-uniformity is a problem associated with vapor lamp operation. When the vapor temperature in the lamp is not uniform across the envelope space between the lamp electrodes, the vapor tends to migrate toward the cooler regions, thereby possibly condensing vapor and tending to lower the vapor pressure in the cooler zone, at least momentarily. Conversely, hot spots produce low vapor molecule concentrations, thereby tending to reduce photon production. In an overall sense, the vapor pressure may remain at a given value, but localized cool spots or hot spots can adversely affect the light output. Temperature uniformity or constancy in the capillary bore section of the lamp contributes to optimized vapor lamp operation.

The present invention contemplates a mechanism for achieving desired temperature uniformity within and along the capillary bore vapor space in a vapor (gas discharge) lamp.

An overall aim of the invention is to provide a low temperature vapor lamp having a relatively high light output. This is achieved through the use of heating means and heat dissipating means for maintaining a satisfactory vapor operating temperature and density in the capillary bore section of the lamp.

BRIEF DESCRIPTION OF THE DRAWINGS

FIG. 1 is a longitudinal sectional view through a mercury vapor lamp embodying the invention;

FIG. 2 is a longitudinal sectional view through another lamp embodying the invention;

FIG. 3 is a sectional view taken on line 3—3 in FIG. 1;

FIG. 4 is a sectional view taken on line 4—4 in FIG. 1;

FIG. 5 is a transverse sectional view taken on line 5—5 in FIG. 2; and FIG. 6 is a view similar to that of FIG. 5, showing another form of a protrusion element of the invention.

DESCRIPTION OF A PREFERRED EMBODIMENT OF THE INVENTION

Referring to the drawing, FIG. 1 shows a vapor (gas discharge) lamp comprising a vapor envelope 10 internally defining two parallel capillary bores 12 and 14. Envelope 10 may be formed of quartz. A transverse connector passage 16 extends between the right-most ends of bores 12 and 14. Passage 16 is defined partly by a light-transmitting window element 15 which is the light output member for the lamp. Window 15 may be formed of quartz for light transmission purposes. Light energy exits the lamp in a left-to-right direction through window element 15.

The left end of capillary bore 12 communicates with an electrode chamber 18. An electrode 20 extends through the left end wall of envelope 10. Another electrode 22 extends through the left end wall of envelope 10 into a second electrode chamber 24 in communication with the left end of capillary bore 14. Electrodes 20 and 22 may be formed of tungsten because of its current-carrying ability.

The enclosed space defined by bores 12 and 14, connector passage 16, and electrode chambers 18 and 24, has a quantity of mercury contained therein to produce a vaporized mercury atmosphere within the enclosed space. Electron flow via electrodes 20 and 22 bombards the vapor molecules, which are thus excited to produce photon (light) energy. As noted above, the light output is axially oriented along bores 12 and 14 through optical window 15. Electron flow is generally along the U-shaped path indicated by dashed line 26 in FIG. 1.

The illustrated lamp thus far described is similar to the lamp structure shown in the aforementioned U.S. Pat. No. 4,877,997. The present invention is concerned in part with electrical heater means for heating selected areas of lamp envelope 10, whereby the mercury vapor in capillary bores 12 and 14 is maintained at or near 40° C.-70° C. Such a temperature is believed to be the optimum temperature for most efficient light production when using mercury vapor as the fluorescent gas. In practice, the operating temperature will be somewhat higher to provide stable performance. Lamps using other vapors (gases, metals or metal hallides) would have different optimum vapor temperatures.

The desired operating temperature may in some cases be achieved without heater means. For example, if the ambient temperature is sufficiently high, the desired temperature may be achieved merely by withdrawing heat from the capillary bore section of the lamp. FIG. 1 shows a lamp construction wherein two heaters are used in conjunction with a heat sink to achieve a desired operating temperature in the capillary bore section of the lamp. FIG. 2 shows a lamp construction wherein temperature control in the capillary bore section is achieved solely through the use of a heat sink in thermal engagement with the capillary bore section.

As shown in FIG. 1, the envelope heater means comprises a first heater section 30 encircling electrode chambers 18 and 24, and a second heater section 32 encircling the transverse connector passage 16. Each heater section may include a multiple number of turns of insulated heater wire extending about the lamp envelope 10. The electrode chamber volume is ordinarily greater than the volume of connector passage 16. Therefore, heater section 30 will have more heater wire turns than heater section 32, assuming the same current flow through each heater wire. The heater sections are designed to heat the vapor in the associated spaces 16, 18 and 24 to a relatively high temperature—e.g., 70° C. to 80° C., or higher temperature utilizing other appropriate materials.

It will be noted that the electrical heater does not surround capillary bores 12 and 14. Normally, the vapor within the capillary bores undergoes a self-heating action due to electron bombardment of the vapor molecules. This self-heating action is most intense within the capillary bores, because the diameter of each bore is relatively small—e.g., only about 0.05 inch or 0.10 inch in diameter. The electron flow is relatively dense within the capillary bores because the available flow path (bore) is relatively constricted and directional. A dense directional electron flow translates into a relatively great vapor self-heating action.

Vapor in bores 12 and 14 may have a temperature higher than the optimum temperature. A thermally conductive heat sink is provided about capillary bores 12 and 14 to remove unwanted heat from the bores. As shown in FIG. 1, the heat sink comprises a tubular sheat 11 encircling envelope 10 and a thermally conductive potting compound 34 filling the annular space between the sheath and the capillary bore section. Sheath 11 is formed of aluminum or other thermally conductive material, whereby heat generated within bores 12 and 14 is dissipated through the thermally conductive members 34 and 11 to the ambient atmosphere.

Electrode chambers 18 and 24 and connector passage 16 would normally be cooler than bores 12 and 14, except for the presence of the heater means. Heater sections 30 and 32 will maintain the vapors at the opposite ends of bores 12 and 14 at a higher temperature than the operating temperature in bores 12 and 14. The vapor within bores 12 and 14 will be maintained at a desired operating temperature by a combination of factors, including the self-heating action of the vapors within the bores and the thermally conductive heat flow from the bores through the associated heat sink (elements 34 and 11). An aim of the system is to maintain the electrode-containment chambers and the transverse passage 16 at a higher temperature than bores 12 and 14, whereby vapor flow is from the higher temperature to the lower temperature, whereby there is always a sufficient vapor fill in bores 12 and 14 for optimum photon generation. The electrical heater, if utilized, is preferably controlled or modulated by a temperature sensor responsive to temperature fluctuations in the capillary bores 12 and 14. FIG. 1 fragmentarily shows a temperature sensor 38 responsive to the temperature of the wall that defines capillary bore 12. Sensor 38 could be a thermocouple or a thermistor connected to a heater control system via an electrical conductor 40.

The FIG. 1 system is intended to so operate that temperature increase in capillary bore 12 above the desired operating temperature causes sensor 38 to turn off the heater sections 30 and 32, thereby somewhat cooling the vapors in transverse passage 16 and chambers 18 and 24. Relatively cool vapors therein can intermix with the vapors in bores 12 and 14 to exert convective cooling effects.

The FIG. 1 system will maintain a fairly uniform vapor density throughout the entire envelope space including the two bores 12 and 14, the two electrode chambers 18 and 24, and the bore connector passage 16. Vapor density uniformity is a contributing factor toward achievement of a desired vapor content in bores 12 and 14, and a relatively high light output through optical element 15.

FIG. 2 shows another embodiment of the invention which operates without electrical heater means. Temperature control of the vapor in bores 12 and 14 is achieved solely by means of a heat sink formed between at least one of the capillary bores and the ambient atmosphere. The heat sink comprises a hollow protrusion 42 formed on the envelope 10 wall at approximately the midpoint of the capillary bore section. To provide good thermal connection between the protrusion and sheath 11, a small hole is preferably defined in the sheath wall, and thermally conductive fusible bonding material 43, such as epoxy, is provided in the hole to enhance thermal contact between the members. The hollow protrusion may extend to the interior surface of the sheath, as shown in FIG. 5, or may extend substantially through the sheath, as indicated at **42*a* in FIG. 6, with fusible bonding material 43*a* in an enlarged opening to provide good thermal contact. Vapor within the hollow protrusion may in some cases condense to form a reservoir of mercury. Self-heating of the vaporous atmosphere within bores 12 and 14 can raise the temperature to vaporize the condensed vapor in hollow protrusion 42, thereby achieving a satisfactory vapor content within the bores 12 and 14** where the vapor content is most important in the achievement of a satisfactory light output.

If desired, a second hollow protrusion could be extended from the envelope wall which forms bore 12.

In both illustrated forms of the invention, temperature control means is provided to maintain the electrode containment chambers 18 and 24 and the light output passage 16 at a higher temperature than the capillary bore passages 12 and 14. With such an arrangement, there is sufficient vapor within the capillary bore section, because the temperature imbalance will cause vapor flow from the higher temperature zones 18, 24 and 16 to the lower temperature zones 12 and 14, even though the capillary bores would otherwise be at higher temperatures due to the self-heating action associated with the small bore dimensions.

Thus there has been shown and described a novel gas discharge lamp temperature control which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

What is claimed is:

1. A gas discharge lamp comprising:

an envelope having an electrode-containment section, a linear capillary bore section, and a light output section, said electrode-containment section comprising two separate electrode chambers, said linear capillary bore section comprising two separate capillary bores extending, respectively, from respective ones of said electrode chambers, said light output section comprising light output means spaced from said capillary bores to define a transverse connector passage between said bores, an electrode extending into each electrode chamber, a fluorescence-producing vaporizable material in said envelope, a tubular metal sheath extending along and about said envelope with the outer surface of the envelope spaced from the sheath inner surface, and a thermal connection between the capillary bore section of the envelope and the metal sheath, said thermal connection being thermally isolated from the electrode-containment section and the light output section, whereby the capillary bore section is maintained at a lower temperature than the electrode-containment section and the light output section.

2. A gas discharge lamp according to claim 1, wherein said thermal connection comprises a thermally-conductive potting material filling the annular space between the capillary bore section and the sheath.

3. A gas discharge lamp according to claim 1, wherein said thermal connection comprises a hollow protrusion extending transversely from the capillary bore section to the sheath.

4. A gas discharge lamp according to claim 3, wherein said hollow protrusion is disposed about midway along the length of the capillary bore section.

5. A gas discharge lamp according to claim 3, wherein said hollow protrusion is in fluid communication with one of said capillary bores, whereby the protrusion forms a reservoir for condensed vaporizable material.

6. A gas discharge lamp according to claim 1, and further comprising:

a first heater within the sheath in encircling relation with the electrode-containment section, and a second heater within the sheath in encircling relation with the light output section.

7. A gas discharge lamp according to claim 6, wherein said first heater has a greater output than that of said second heater.

8. A gas discharge lamp according to claim 7, wherein each heater is an electrically-energized heater.

9. A gas discharge lamp according to claim 8, wherein:

said thermal connection comprises a thermally-conductive potting material filling the annular space between the capillary bore section and the metal sheath.

* * * * *